US005351817A

United States Patent [19]

Sutherland

[11] Patent Number: 5,351,817

[45] Date of Patent: Oct. 4, 1994

[54] REINFORCED CLIP-TYPE ARTICLE CARRIER

[75] Inventor: Robert L. Sutherland, Kennesaw, Ga.

[73] Assignee: Riverwood International Corporation, Atlanta, Ga.

[21] Appl. No.: 136,525

[22] Filed: Oct. 14, 1993

[51] Int. Cl.[5] ..... B65D 71/12

[52] U.S. Cl. ..... 206/153; 206/147

[58] Field of Search ..... 206/145-160, 206/427

[56] References Cited

U.S. PATENT DOCUMENTS

| | | | |
|---|---|---|---|
| 2,737,326 | 3/1956 | Toensmeier | 294/87.2 |
| 3,118,537 | 1/1964 | Copping | 206/153 |
| 3,229,892 | 1/1966 | Weiss | 206/152 |
| 3,245,711 | 4/1966 | Dantoin | 206/153 |
| 3,372,800 | 3/1968 | Arneson | 206/154 |
| 3,606,003 | 9/1971 | Graser | 206/153 |

*Primary Examiner*—Jimmy G. Foster

[57] ABSTRACT

A clip-type carrier especially suited for carrying beverage cans. The carrier is comprised of a panel having slots in folded, wedge-shaped inner support sections and in outer support sections for receiving the can chimes. The inner support sections are connected to rib sections which are foldably connected, forming a two-ply vertical rib extending up from the bottom of the wedge. Glue flaps extending from the rib are adhered to the carrier panel to maintain the carrier in locked condition.

16 Claims, 2 Drawing Sheets

REINFORCED CLIP-TYPE ARTICLE CARRIER

FIELD OF THE INVENTION

This invention relates to carriers of the type that support articles from the underside of flanges or other lateral projections on the articles. More particularly, it relates to carriers of this type which have improved strength.

BACKGROUND OF THE INVENTION

Carriers that grip the upper portions of articles to enable the articles to be lifted and carried are known, particularly in connection with the packaging of beverage cans. Clip-type paperboard carriers developed for this purpose fall into two basic design groups. In one design a panel is provided with apertures corresponding to the tops of the cans, with foldably connected tabs surrounding the apertures. The top portions of the cans extend through the apertures and the edges of the tabs engage the underside of the can chimes to support the cans. This produces an inherently weak carrier due to the fact that much of the panel is removed in forming the apertures. In addition, there is very little surface area capable of receiving printing or other graphics, and the provision of a handle for lifting the carrier further complicates the design and makes the carrier more expensive.

In the second basic design, slots are provided in a panel for receiving opposite portions of the can chimes, with adjacent panel edges resulting from the slot formation engaging the underside of the can chime portions. This is typically employed in packages comprised of two adjacent rows of cans, so that the elongated area of the panel between the interior slots folds into a wedge-shaped reinforcing rib extending between the sloped upper portions of the cans. Short side panels connect the panel to top panel flaps, which are glued to the bottom panel, and aligned finger openings in the top panel and in the reinforcing wedge enable the package to be lifted and carried. Although such a carrier provides substantially unbroken areas in the top panel for receiving printed indicia, it falls short of providing the desired level of strength and is relatively expensive to produce.

As a means of simplifying the carrier the top panel flaps could be eliminated, but this weakens the carrier since the reinforcing function supplied by the top panel flaps would be absent. It would be desirable to be able to provide a clip-type carrier which does not require top panel flaps, but which nonetheless possesses adequate strength to withstand the forces generated during lifting and carrying. Such a carrier should also be economical to manufacture, and therefore should be capable of being formed from a single unitary blank.

BRIEF SUMMARY OF THE INVENTION

The clip-type carrier of the invention employs certain basic elements common to the second basic design discussed above. Thus it is comprised of a support panel which includes two spaced parallel inner fold lines and two outer fold lines parallel to and outwardly spaced from the inner fold lines. The support panel includes downwardly extending outer support sections connected to the panel along the outer fold lines and downwardly extending inner support sections connected along the inner fold lines, the inner support sections converging toward each other to form wedge-shaped reinforcing ribs. Each inner and outer fold line is interrupted by spaced slits which form slots in the support sections for receiving portions of the projecting lips of two rows of articles to thereby support the articles. In addition to these elements the invention provides a rib which extends upwardly from the inner support sections and glue flaps which extend outwardly from the rib. The glue flaps are adhered to the support panel on opposite sides of the rib, thus locking the carrier in closed position to securely support the articles. The rib also provides additional reinforcement.

In a preferred arrangement the rib extends upwardly from the lower extremities of the converging inner support sections, and is of two-ply construction, each ply being foldably connected to one of the inner support sections. The glue flaps preferably comprise two pairs of oppositely located flaps, each pair containing a finger hole for use in lifting the carrier. A gap in the upstanding rib directly beneath each finger hole provides space for the finger of a user. The carrier is formed from a single blank of generally rectangular shape and is economical to produce.

The features of the invention which enable it to provide the desired results are brought out in more detail in the description of the preferred embodiment, wherein the above and other aspects of the invention, as well as other benefits, will readily become apparent.

DETAILED DESCRIPTION OF THE PREFERRED EMBODIMENT

Figure 1:
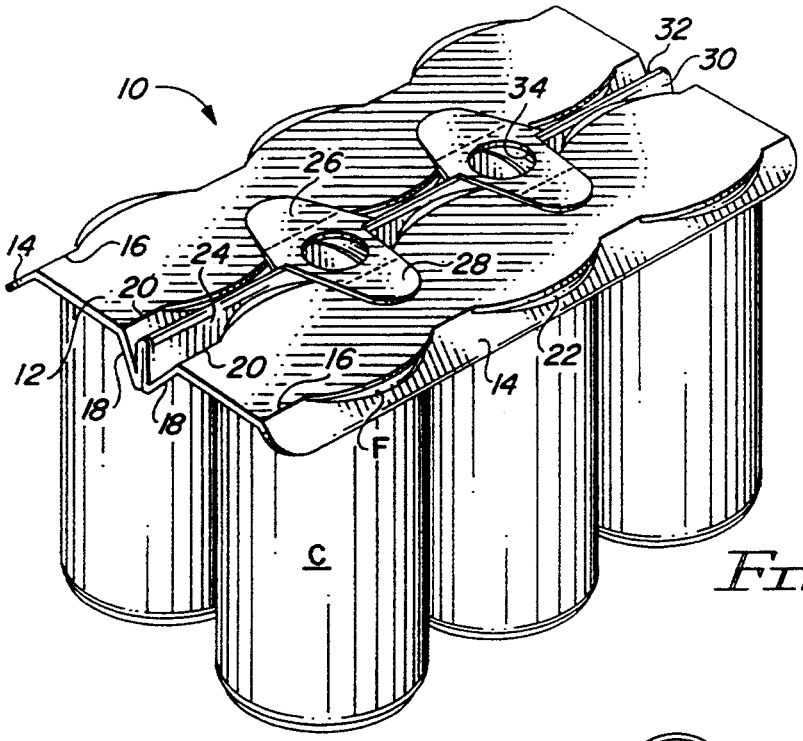
FIG. 1 is a pictorial view of a package of beverage cans the top portions of which are supported by the carrier of the invention.
Figure 2:
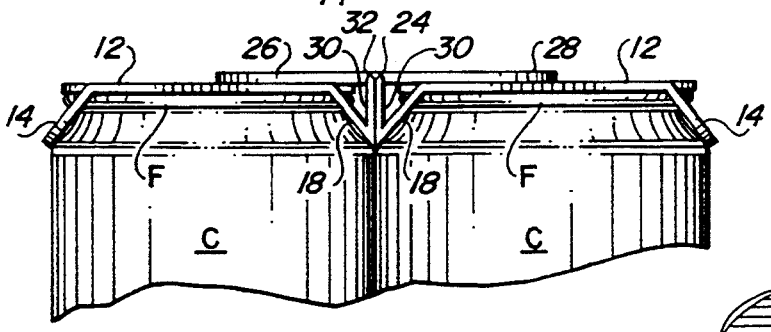
FIG. 2 is an end view of the package of FIG. 1.

Referring to FIG. 1, a carrier 10, formed of paperboard or other suitable sheet material having adequate strength and flexibility to enable it to be formed into a carrier and to withstand the stresses of handling and shipping, is comprised of a panel 12 having side edge portions 14 which are folded down about fold lines 16. The central portion of the panel includes angled ribs 18 which meet along their lower extremity and which are connected to the panel 12 by parallel fold lines 20. The chimes or flanges F of cans C protrude through slots 22 in the edge portions 14 and through similar slots in the ribs 18. An upstanding rib 24 extends up from the lower extremities of the angled ribs 18 and is connected to glue flaps 26 and 28, which are adhered to the upper surface of the panel 12. As best shown in FIG. 2, the rib 24 is formed by extensions 30 of the ribs 18, which are in face-to-face relationship and are connected to each other along fold line 32. Each pair of glue flaps 26, 28 includes a finger opening 34 overlying a cutout portion of the vertical rib 24. This arrangement allows the fingers, or a thumb and finger, of a user's hand to grasp the carrier to lift it. Although the carrier is illustrated is being adapted to carry six cans, it will be understood that the invention is not limited by the number of articles supported by the carrier. The articles to be carried must be arranged in a plurality of rows, however, in order to create the angled ribs 18 and the central rib 24.

Figure 3:
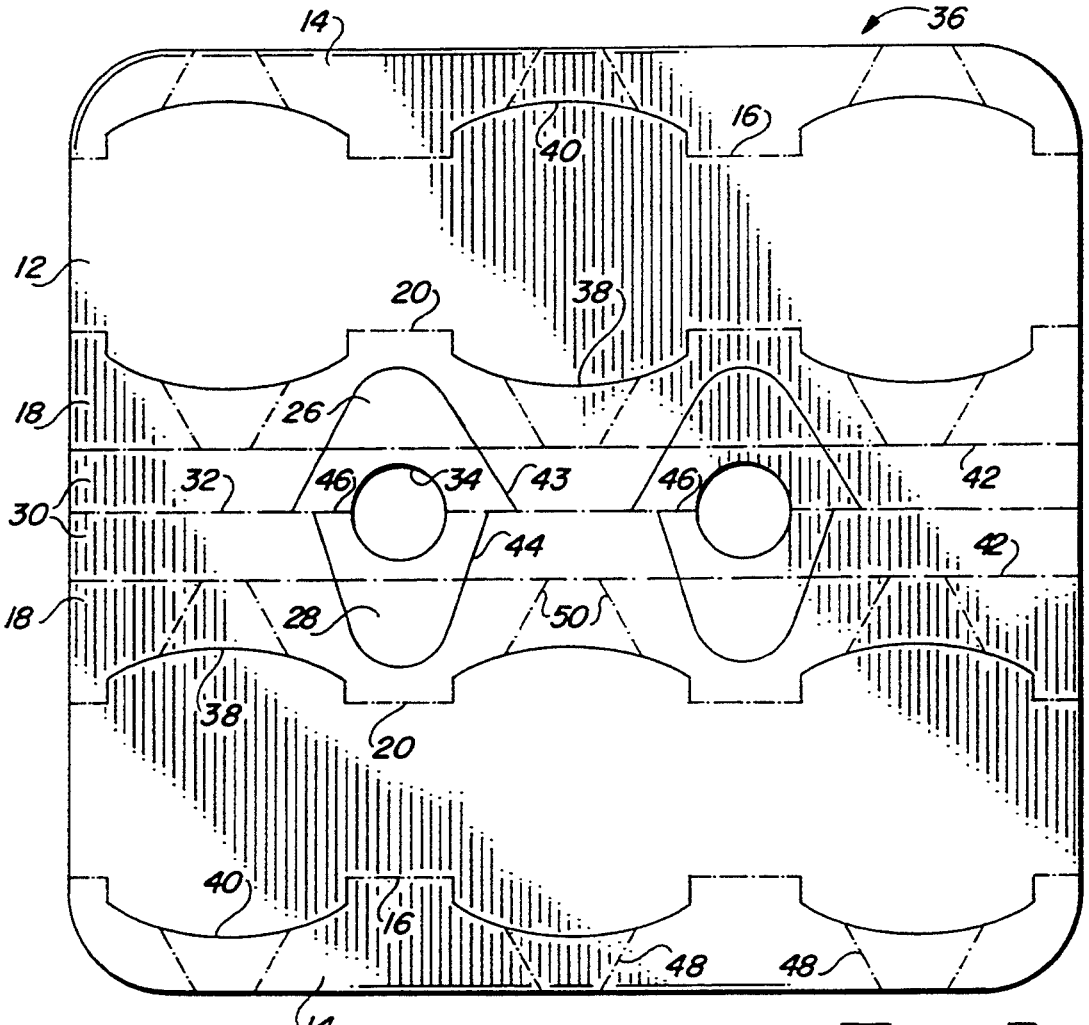
FIG. 3 is a plan view of a blank for forming the carrier of FIG. 1.

Referring to FIG. 3, wherein like reference numerals to those used in FIG. 1 denote similar elements, the carrier is formed from a generally rectangular blank 36. The fold line 32 is centrally located and, except for being interrupted by the finger holes 34, extends the full length of the panel 12. The parallel fold lines 20, which create the rib sections 18, are each interrupted by three curved slits 38, which may be referred to as C-shaped slits, the convex sides of which face the central fold line 32. Each fold line 16 is also interrupted by three similar but oppositely facing slits 40.

The sections 30 which form the two-ply vertical rib 24 of the carrier are connected to the rib sections 18 by fold lines 42 and to each other by the central fold line 32. Also connected to portions of the central fold line 32 are the glue flaps 26 and 28, each of which contains half of the cutout forming the finger hole 34. Slits 43 extend from the fold line 32 through one of the rib sections 30 into the adjacent rib section 18 to form the glue flaps 26, while slits 44 extend from the fold line 32 through the other rib section 30 into the other rib section 18 to form the glue flaps 28. This results in the glue flaps 26 and 28 including portions of the fold lines 42. The glue flaps 28 are slightly smaller than the glue flaps 26 as a result of the slits 44 connecting the fold line 32 at points between the finger hole and the ends of the slits 43. Preferably, the short portions 46 of the fold line 32 which serve as common fold lines for both glue flaps 26 and 28 are comprised of score lines so as to resist tearing at the finger holes. It will be recognized that the slits 43 and 44 could intersect the fold line 32 at the same point, making one glue flap a continuation of the other. This would, however, require longer portions of the fold line 32 to be in the form of a score line, which makes it more difficult for the vertical rib sections 30 to fold up against each other. The illustrated arrangement is the preferred compromise between strength of the glue flap connections and foldability of the rib sections 30.

Although not illustrated, the glue flap slits 43 and 44 may be formed so that the flaps are connected to the panel 12 by readily torn or severed short connecting portions. This ensures that the flaps remain in the plane of the blank until a package is formed to prevent interference with stacking and handling of the blanks.

Angled score lines 48 extend from the side edges of the panel to the slits 40 to facilitate conforming the edge panel portions 14 to the curvature of the cans and to distribute lifting stresses to the ends of the support sections. The rib sections 18 contain angled score lines 50 for the same purposes.

In addition to the score line segments 46 of the fold line 32, it is preferred that the fold lines 16 and 20 also be in the form of score lines to make the carrier more rigid and resistant to tearing. The fold lines 42 and the remaining portions of the fold line 32 are preferably in the form of skip-cut lines to facilitate folding of the blank along these lines during formation of the carrier.

Figure 4:
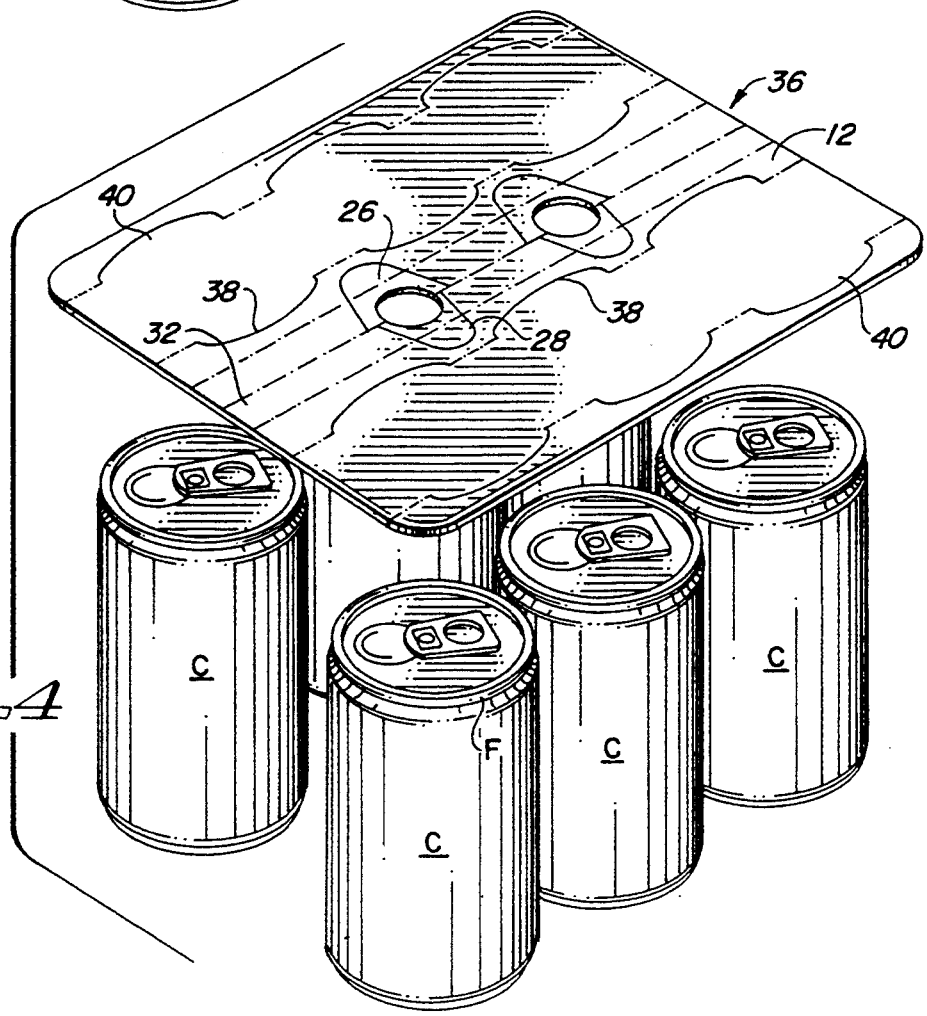
FIG. 4 is a pictorial view of the blank and cans to be packaged as they appear at the initial stage of forming a carrier.

To form the carrier of FIG. 1, the blank 36 is positioned on top of a group of six adjacent cans C which have been arranged in two rows of three each so that the C-shaped slits are aligned with opposite portions of the rims of the cans, as illustrated in FIG. 4. Since the rib sections 18 and 30 are still in planar unfolded condition at this point, the two rows of cans will be spaced apart a short distance in order to be properly aligned with the blank, as is well known in the art. Relative movement between the blank and the cans is caused by applying downward pressure to the blank. Since the distance between the midpoints of opposite C-shaped slits 38 and 40 is substantially equal to the reduced diameter portion of a can just below the can chime, when relative movement of the cans and blank occurs the can chimes are forced through the slits due to the resiliency of the paperboard until the locking edges formed by the C-shaped slits at the reinforcing rib sections 18 and the edge portions 14 snap back into the reduced diameter portion of the cans. During this maneuver, the locking edges formed by the C-shaped slits move downwardly relative to the panel 12, causing the rib sections 18 to fold down about the fold lines 20 and up about the fold lines 42. This moves the two rows of cans toward each other and also causes the rib sections 30 to fold down about the central fold line 32.

Figure 5:
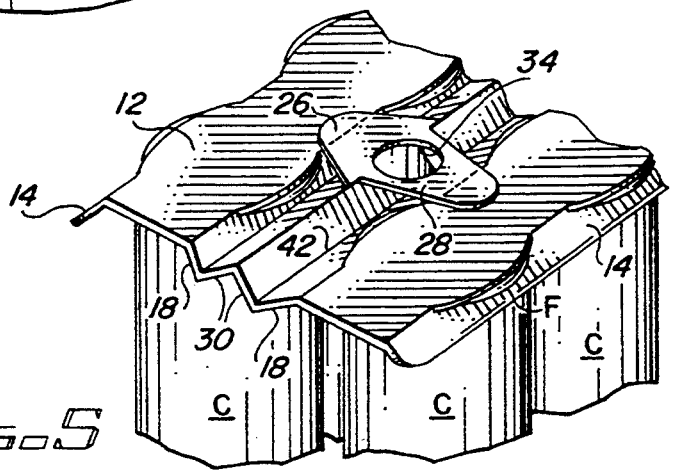
FIG. 5 is a partial pictorial view of the blank and cans at an intermediate stage of forming a carrier.

FIG. 5 illustrates an intermediate position of the ribs as they are moving toward the final position shown in FIGS. 1 and 2. As the rib sections 18 and 30 start to fold, the glue flaps remain in a substantially horizontal plane and move with the fold line 32 up out of the original plane of the blank. When the rib sections 30 eventually move to their final vertical position shown in FIGS. 1 and 2, the outer portions of the glue flaps overlie the carrier panel support 12 and are glued to the panel 12. As a result, the glue flaps hold the carrier in locked condition, maintaining the ribs 18 and 24 in their reinforcing position. The central vertical rib 24 not only assists the ribs 18 in supporting the cans, but also functions as a handle panel through which lifting stresses may be distributed. Lifting of the carrier by means of the finger holes is readily accomplished due to the adherence of the glue flaps to the carrier support panel. As mentioned above, the score line portions of the fold line 32 adjacent the finger holes resist tearing at this critical location.

When the glue flaps are in their final position the portions of the fold lines 42 extending through them substantially overlie the fold lines 26 extending between adjacent C-shaped slits 38. This allows the slight flexing that normally occurs along the fold lines 26 during lifting and carrying to take place even though the glue flaps overlie the area of the panel 12 containing these segments of the fold lines 26.

It is not necessary to glue the plies of the rib 24 together since they will normally be prevented from separating by the adherence of the glue flaps to the main carrier panel. Gluing of these plies can be done, however, if it is desired to provide an extra secure carrier.

During carrier formation the blank may be moved relative to the cans by any suitable means. Although details of apparatus for carrying out these functions are not disclosed herein, the design of such equipment is known and is well within the scope of those skilled in the packaging art. For example, the method of assembly disclosed in U.S. Pat. No. 3,653,503 could be employed.

It will now be clear that the invention improves the strength of clip-type paperboard carriers by means of a novel reinforcement and handle arrangement without increasing their cost. Obviously, although the invention has been described in connection with a carrier designed to hold six beverage cans, the principles of the invention may be incorporated in carriers designed to hold fewer or more cans. Moreover, the invention is not limited to use with cans, but may be extended to other types of articles having a rim or other projection capable of being gripped by locking or supporting edges of the carrier. Because the invention is not necessarily limited to all the specific details described in connection with the preferred embodiment, except as they may be within the scope of the appended claims, changes to certain features of the preferred embodiment which do not alter the overall basic function and concept of the invention are contemplated.

What is claimed is:

1. A clip-type carrier containing adjacent rows of articles, each article having an upper portion which includes an outwardly projecting lip, comprising:

a support panel including two spaced parallel inner fold lines and two outer fold lines parallel to and outwardly spaced from the inner fold lines;

the support panel including downwardly extending outer support sections connected thereto along the outer fold lines and downwardly extending inner support sections connected thereto along the inner fold lines, the inner support sections converging toward each other;

each inner and outer fold line being interrupted by spaced slits forming slots in the support sections through which at least portions of the projecting lips of the articles protrude;

the slots having lower surfaces engaging the underside of the protruding portions of the article lips to thereby support the articles;

a rib extending upwardly from the inner support sections; and glue flaps extending from the rib and being adhered to the support panel on opposite sides of the rib.

2. A carrier according to claim 1, wherein the rib extends upwardly from the lower extremities of the converging inner support sections.

3. A carrier according to claim 2, wherein the rib is of two-ply construction, each ply being connected to one of the inner support sections along a first fold line and to each other along a second fold line.

4. A carrier according to claim 1, wherein the glue flaps comprise a pair of oppositely located flaps, each flap containing an opening for use in lifting the carrier.

5. A carrier according to claim 4, wherein one flap is foldably connected to the rib along spaced portions of the rib, said spaced portions being outwardly spaced from the finger hole.

6. A carrier according to claim 5, wherein the other flap is foldably connected to said one flap at locations inwardly spaced from the connection of said one flap to the rib.

7. A carrier according to claim 4, wherein the rib includes a cutout directly beneath the finger hole, whereby the finger of a user can be inserted into the flap openings without interference from the rib.

8. A carrier according to claim 4, wherein the glue flaps comprise two substantially similar pairs of oppositely located flaps, the pairs of flaps being spaced apart so that the thumb and finger of a user can be inserted into the openings of the spaced pairs of flaps.

9. A carrier according to claim 1, wherein each glue flap contains a fold line substantially overlying a portion of said inner fold lines.

10. A carrier according to claim 1, wherein the articles in the package are cans and the outwardly extending flanges of the articles are can chimes, the support panel directly overlying the top surfaces of the cans.

11. A clip-type carrier containing adjacent rows of articles, each article having an upper portion which includes an outwardly projecting lip, comprising:

a support panel including two parallel downwardly extending outer support sections at opposite ends of the panel and two downwardly extending inner support sections parallel to said outer support sections and converging toward each other;

each inner and outer support section including slots through which at least portions of the projecting lips of the articles protrude;

a rib extending upwardly from the inner support sections; and glue flaps extending from the rib and being adhered to the support panel on opposite sides of the rib.

12.A blank for forming a clip-type carrier adapted to support adjacent rows of articles from outwardly projecting lips on the upper portions of the articles, comprising:

a generally rectangular sheet including two spaced parallel inner fold lines extending longitudinally of the sheet and two outer fold lines parallel to and outwardly spaced from the inner fold lines;

the sheet including outer support sections connected thereto along the outer fold lines and inner support sections connected thereto along the inner fold lines;

each inner and outer fold line being interrupted by spaced slits forming slots .in the support sections for receiving at least portions of the projecting lips of the articles to be carried;

the edges of the inner and outer support sections formed by folding the inner and outer support sections down about their connecting fold lines being adapted to engage the underside of the outwardly projecting lips of articles;

each inner support section being connected to a rib section along a fold line;

the rib sections being connected to each other along a central fold line so as to form an upwardly extending two-ply rib in a carrier formed from the blank; and a plurality of slits extending from the central fold line into the inner support sections and the rib sections, each slit having ends beginning and terminating at spaced points on the central fold line, the slits forming glue flaps which are adhered to the sheet between the inner and outer fold lines in a carrier formed from the blank.

13. A carrier blank according to claim 12, wherein the glue flaps formed from the glue flap slits include extensions of the fold lines connecting the inner support sections to the rib sections, said extensions being located so as to substantially overlie portions of the inner fold lines of a carrier formed from the blank.

14. A blank for forming a clip-type carrier adapted to support adjacent rows of articles from outwardly projecting lips on the upper portions of the articles, comprising:

a generally rectangular sheet including two spaced parallel inner fold lines extending longitudinally of the sheet and two outer fold lines parallel to and outwardly spaced from the inner fold lines;

the sheet including outer support sections connected thereto along the outer fold lines and inner support sections connected thereto along the inner fold lines;

each inner and outer fold line being interrupted by spaced slits forming slots in the support sections for receiving at least portions of the projecting lips of the articles to be carried;

the edges of the inner and outer support sections formed by folding the inner and outer support sections down about their connecting fold lines being adapted to engage the underside of the outwardly projecting lips of articles;

each inner support section being connected to a rib section along a fold line;

the rib sections being connected to each other along a central fold line so as to form an upwardly extending two-ply rib in a carrier formed from the blank; and slits in the inner support sections and the rib sections forming glue flaps which are adhered to the sheet between the inner and outer fold lines in a carrier formed from the blank, the glue flap slits forming a pair of oppositely located flaps, each flap containing a cutout for use in lifting the carrier.

15. A carrier blank according to claim 14, wherein the glue flap slits terminate substantially at the central fold line, the ends of the slit of one flap being outwardly spaced from the ends of the other slit.

16. A carrier blank according to claim 14, wherein the glue flap slits comprise two substantially similar pairs of oppositely located slits, the pairs of flaps formed thereby being spaced apart so that the thumb and finger of a user can be inserted into the openings of the spaced pairs of flaps.

* * * * *